US007175582B2

(12) United States Patent
Owen

(10) Patent No.: US 7,175,582 B2
(45) Date of Patent: Feb. 13, 2007

(54) METHOD AND APPARATUS FOR REGISTERING FASTENER TAPE IN PACKAGING MACHINE

(75) Inventor: Kevin Owen, Flowery Branch, GA (US)

(73) Assignee: Illinois Tool Works Inc., Glenview, IL (US)

( * ) Notice: Subject to any disclaimer, the term of this patent is extended or adjusted under 35 U.S.C. 154(b) by 66 days.

(21) Appl. No.: 11/125,607

(22) Filed: May 9, 2005

(65) Prior Publication Data

US 2006/0252625 A1 Nov. 9, 2006

(51) Int. Cl.
*B31B 1/90* (2006.01)
*B65B 61/18* (2006.01)

(52) U.S. Cl. ..... 493/213; 493/11; 493/15; 493/393; 53/412; 53/133.4; 53/139.2

(58) Field of Classification Search ..... 493/11, 493/13, 15, 213, 214, 393, 394, 927; 53/412, 53/133.4, 139.2; 29/766, 768
See application file for complete search history.

(56) References Cited

U.S. PATENT DOCUMENTS 6,327,754 B1 * 12/2001 Belmont et al. ..... 383/63
6,770,018 B2 * 8/2004 Tomic ..... 493/927
6,780,146 B2 * 8/2004 Thomas et al. ..... 53/412
6,842,973 B2 * 1/2005 Share et al. ..... 29/768
6,843,038 B1 * 1/2005 Haws ..... 53/139.2
6,973,704 B2 * 12/2005 Cortigiano, Sr. ..... 29/768
2002/0152720 A1 * 10/2002 Kinigakis et al. ..... 53/412
2003/0162643 A1 * 8/2003 Tomic ..... 493/394
2003/0183314 A1 * 10/2003 Share et al. ..... 29/768

* cited by examiner

*Primary Examiner*—Louis Huynh
(74) *Attorney, Agent, or Firm*—Ostrager, Chong, Flaherty & Broitman P.C.

(57) ABSTRACT

Methods and apparatus for controlling the registration of a first elongated continuous structure (e.g., plastic fastener tape) with attachments (e.g., sliders) or formed features (e.g., slider end stop structures), as it is fed to a sealing station, where it is joined to a second elongated continuous structure (e.g., a web of packaging material) with formed features (e.g., thermoformed troughs). The second elongated continuous structure is intermittently advanced through the machine by the same distance each advancement. During each dwell time, the first elongated continuous structure is processed, i.e., structural features are attached and/or formed. Proper registration of the structural features on the first elongated continuous structure with the second elongated continuous structure is accomplished by adjusting the distance that the unjoined upstream portion of the first elongated continuous structure advances as a function of feedback acquired downstream.

24 Claims, 5 Drawing Sheets

METHOD AND APPARATUS FOR REGISTERING FASTENER TAPE IN PACKAGING MACHINE

BACKGROUND OF THE INVENTION

The present invention generally relates to methods and apparatus for controlling the registration of regularly reoccurring structural features on one web, tape or strand of continuous material relative to regularly reoccurring structural features on another web, tape or strand of continuous material during joinder. In particular, the invention relates to methods and apparatus for registering modifications (or inserted articles) on a plastic fastener tape relative to thermoformed structures on a plastic packaging material in a thermoform-fill-seal (TFFS) machine.

During the automated manufacture of reclosable packages, a thermoplastic fastener tape unwound from a supply reel or spool is joined (e.g., by conductive heat sealing) to a web of thermoplastic packaging material. The web-to-fastener tape sealing operation can be performed either intermittently (i.e., during dwell times interspersed between intermittent advancements) or continuously (i.e., while the fastener tape and web are advancing continuously).

In cases where a fastener tape without pre-sealing and without sliders must be joined with a web of packaging material having thermoformed troughs or tubs (hereinafter "troughs"), there is a need for the fastener tape to be properly aligned with the web of film (i.e., straightness and cross-machine alignment), but there is no need to register the fastener tape relative to the web in a machine direction. This is due to the fact that the fastener tape has a constant profile along its length and thus has no structural features that need to be registered relative to the troughs thermoformed on the web of packaging material.

The fastener tape typically comprises a pair of continuous zipper strips, each zipper strip having a respective constant profile produced by extrusion. Typically, the respective zipper strip profiles have complementary shapes that allow the zipper strips to be interlocked. These closure profiles may be of the rib-and-groove variety, the interlocking-hook variety or any other suitable fastenable structures. Pre-sealing of the fastener tape involves crushing and fusing the zipper strips at spaced intervals along the fastener tape at locations where the fastener tape will be ultimately cut when each finished package is severed from the work in process. In cases where the fastener tape is pre-sealed before entering the packaging machine, it is important that the pre-seals be properly registered relative to the troughs thermoformed on the web of packaging material.

In cases where sliders are inserted at spaced intervals along the fastener tape before the latter enters the packaging machine, it is common to combine the joinder of the zipper strips at spaced intervals with the formation of slider end stop structures on the fastener tape. Although slider end stops can be placed on or inserted in the fastener tape, it is common practice to simply deform and fuse the thermoplastic material of the zipper strips wherever slider end stops are needed. Typically, the zipper material is softened by applying ultrasonic wave energy and the thus-softened zipper material is shaped to form a slider end stop structure. Typically the slider end stop structure, when bisected, will form back-to-back slider end stops for adjacent packages. The slider end stop structure is formed at a location such that its midplane will be generally coplanar with the plane of cutting when the finished package is severed from the work in process. The plane of cutting, in turn, is typically located midway between successive thermoformed troughs in the packaging material. Thus, it is important that the slider end stop formations on the fastener tape be properly registered relative to the troughs thermoformed on the web of packaging material film.

There is a need for a simple, inexpensive and accurate scheme for controlling the registration of one elongated continuous structure (e.g., plastic fastener tape) with attachments (e.g., sliders) or formed features (e.g., slider end stop structures), as it is fed to a sealing station, where it is joined to another elongated continuous structure (e.g., a web of packaging material) with formed features (e.g., thermoformed troughs). The registration control equipment should also be easy to install.

BRIEF DESCRIPTION OF THE INVENTION

The present invention is directed to methods and apparatus for controlling the registration of a first elongated continuous structure (e.g., plastic fastener tape) with attachments (e.g., sliders) or formed features (e.g., slider end stop structures), as it is fed to a sealing station, where it is joined to a second elongated continuous structure (e.g., a web of packaging material) with formed features (e.g., thermoformed troughs). The second elongated continuous structure is intermittently advanced through the machine by the same distance each advancement, carrying the joined downstream portion of the first elongated continuous structure therewith. The unjoined upstream portion of the first elongated continuous structure is also advanced intermittently, but by independently adjustable means. During each dwell time, the first elongated continuous structure is processed, i.e., structural features are attached and/or formed. Since the first elongated continuous structure is advanced after each dwell time, each type of structural feature attached and/or formed thereon will be repeated at spaced intervals along the downstream portion of the first elongated continuous structure. Proper registration of the structural features on the first elongated continuous structure with the second elongated continuous structure is accomplished by adjusting the distance that the unjoined upstream portion of the first elongated continuous structure advances as a function of feedback acquired downstream.

Although the embodiments disclosed hereinafter involve the manufacture of thermoformed packages with slider-zipper assemblies, it should be appreciated that the broad concept of the invention has application in other situations wherein two elongated continuous structures must be alternatingly joined and advanced while maintaining accurate registration of the materials in the zone of joinder.

One aspect of the invention is a method of manufacture comprising the following steps: (a) during a respective indexing portion of a respective work cycle, advancing a first elongated continuous structure made of flexible material along a first process pathway, the first elongated continuous structure not advancing during a dwell time of a respective work cycle; (b) during each dwell time, forming or attaching a respective structural feature of a first type on the portion of the first elongated continuous structure that is resident at a first fixed station situated along the first process pathway, the structural features of the first type being spaced at intervals along the portion of the first elongated continuous structure that is downstream of the first fixed station; (c) during the indexing portion of each work cycle, advancing a second elongated continuous structure made of flexible material along a second process pathway by the same distance, the first and second process pathways becoming a common process pathway at a point downstream of the first fixed station and at or upstream of a second fixed station, the second elongated continuous structure not advancing during each dwell time; (d) during each dwell time, joining respective portions of the first and second elongated continuous structures that are resident at the second fixed station, thereby forming respective band-shaped zones of joinder disposed in sequence along the portion of the common process pathway downstream of the second fixed station; (e) during each dwell time, forming a respective structural feature of a second type on the portion of the second elongated continuous structure that is resident at a third fixed station situated along the second process pathway upstream of the common process pathway, the structural features of the second type being spaced at intervals along the portion of the second elongated continuous structure that is downstream of the third fixed station; (f) monitoring the length of the portion of the second elongated continuous structure that passes a fixed point along the common process pathway during an advancement thereof; (g) during an advancement of the first elongated continuous structure and at a fourth fixed station disposed downstream of the first fixed station, monitoring the distance between respective boundaries of successive ones of the structural features of the first type spaced along the first elongated continuous structure; and (h) comparing the monitored length and the monitored distance.

Another aspect of the invention is a system comprising a packaging machine, a fastener processing machine, a fastener tape comprising mutually interlocked first and second zipper strips made of flexible material that follow a pathway through the fastener processing machine and then through the packaging machine, and a controller for controlling the operation of the packaging machine and the fastener processing machine, wherein: the fastener processing machine comprises a supply reel having a portion of the fastener tape wound thereon with a paid-out portion of the fastener tape connected thereto, a first device for attaching or forming a respective structural feature of a certain type on the section of the paid-out portion of the fastener tape that is resident in a fixed zone along the first process pathway, means for advancing the section that is resident in the fixed zone along the pathway and toward the packaging machine, and a sensor that detects a boundary of each passing structural feature of the certain type as the fastener tape is advanced; the packaging machine comprises a supply roll having portions of a web of bag making material wound thereon with a paid-out portion of the web connected thereto, means for advancing the paid-out portion of the web, an encoder for encoding the distance traveled by the advancing paid-out portion of the web, and a second device for joining respective sections of the paid-out portions of the fastener tape and the web to each other while the paid-out portions of the fastener tape and the web are stationary; and the controller is programmed to control the operation of the first and second devices, the fastener tape advancing means, and the web advancing means so that during an advancement phase of each work cycle, the web advancing means advances the web and the fastener tape advancing means advances the fastener tape; and during a dwell time of each work cycle, the first and second devices are activated, and is further programmed to adjust the distance that the fastener tape advancing means advances the fastener tape during a subsequent advancement when signals output by the sensor and the encoder during prior advancements indicate a predetermined difference between the distance traveled by the advancing paid-out portion of the web and the distance between boundaries of successive structural features of the certain type.

A further aspect of the invention is a method of manufacture comprising the following steps: (a) during a respective indexing portion of a respective work cycle, advancing a first elongated continuous structure made of flexible material along a first process pathway, the first elongated continuous structure not advancing during a dwell time of a respective work cycle; (b) during each dwell time, forming or attaching a respective structural feature of a certain type on the portion of the first elongated continuous structure that is resident at a first fixed station situated along the first process pathway, the structural features of the certain type being spaced at intervals along the portion of the first elongated continuous structure that is downstream of the first fixed station; (c) during the indexing portion of each work cycle, advancing a second elongated continuous structure made of flexible material along a second process pathway by the same distance, the first and second process pathways becoming a common process pathway at a point downstream of the first fixed station and at or upstream of a second fixed station, the second elongated continuous structure not advancing during each dwell time; (d) during each dwell time, joining respective portions of the first and second elongated continuous structures that are resident at the second fixed station, thereby forming respective band-shaped zones of joinder disposed in sequence along the portion of the common process pathway downstream of the second fixed station; and (e) adjusting the distance that the portion of the first elongated continuous structure that is resident at the first fixed station advances during a subsequent advancement as a function of the difference between the distance traveled by the web during a prior advancement and the distance between boundaries of successive structural features of the certain type on a portion of the first elongated continuous structure that is disposed between the first and second fixed stations at the time of the prior advancement.

Other aspects of the invention are disclosed and claimed below.

BRIEF DESCRIPTION OF THE DRAWINGS

Reference will now be made to the drawings in which similar elements in different drawings bear the same reference numerals.

DETAILED DESCRIPTION OF THE INVENTION

One embodiment of the present invention will be described in the context of a TFFS machine that applies fastener tape with sliders to thermoformed packaging material. However, it should be understood that the invention is not limited in its application to TFFS machines. The broad scope of the invention will be apparent from the claims that follow this detailed description.

Figure 1:
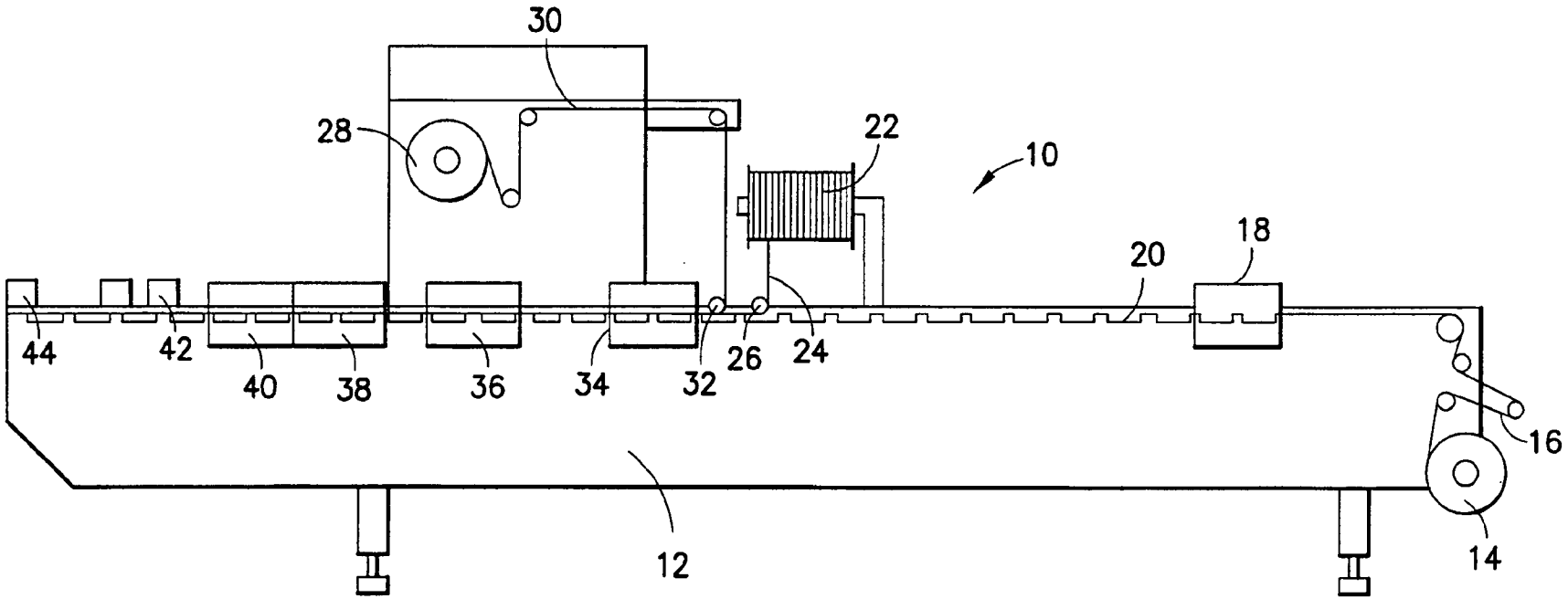
FIG. 1 PRIOR ART
FIG. 1 is a drawing showing a side view of a known TFFS machine with omitted front plate.

Referring to FIG. 1, a known TFFS machine 10 comprises a machine frame 12 with an inlet side and an outlet side. A bottom web of packaging material 16 is unrolled from a supply roll 14 located at the inlet side, grasped by damper chains (not shown) guided at both sides of the machine frame in known manner and passed to the outlet side through the various working stations. The bottom web 16 is first fed to a thermoforming station 18, where successive troughs 20 for receiving the product (not shown) to be packed are formed by deep-drawing using vacuum and heat. At a position following the filling station (not shown in FIG. 1), a closure means 24 is unrolled from a supply roll 22 and fed around a deflection roller 26 onto the bottom web 16 such that the closure means 24 are deposited on a web section (not thermoformed) adjacent the column of thermoformed troughs 20 (best seen in FIG. 2). The loading or filling of each trough 20 occurs in the region between thermoforming station 18 and deflection roller 26, but the loading or filling means are not shown in FIG. 1.

Still referring to FIG. 1, thereafter a top or cover web of packaging material 30 is guided from a supply roll 28 via a deflection roller 32 on top of the bottom web 16 and the closure means 24. The top and bottom webs, with the closure means 24 sandwiched therebetween, are advanced to a sealing station 34 and halted. During a dwell time, the section of the closure means within the sealing station is sealed to the contacting section of the bottom web, while the top and bottom webs are sealed together along a portion of the periphery of the trough. This partially sealed section is thereafter advanced to the following stations in sequence: an evacuation and sealing station 36, a final or post-sealing station 38, a cooling station 40, a transverse cutting station 42, and a lengthwise (i.e., longitudinal) cutting station 44. At station 36, the top and bottom webs are sealed together along the remainder of the trough periphery while the filled trough is evacuated. Also, the top web is sealed to the closure means. At station 38, a transverse seal is made across the full width of the package, including where the portion with the closure means. In the following stations the packages are further processed and, in particular, are severed or separated in conventional manner. The operations of the various activatable packaging machine components depicted in FIG. 1 may be controlled by a conventional programmed logic controller (PLC) in well-known manner.

Alternatively, it is possible to design a TFFS machine that processes two or more columns of packages, each column receiving its own closure means. In that case, all of the operations described in the preceding paragraph would be performed for each column of packages.

Figure 2:
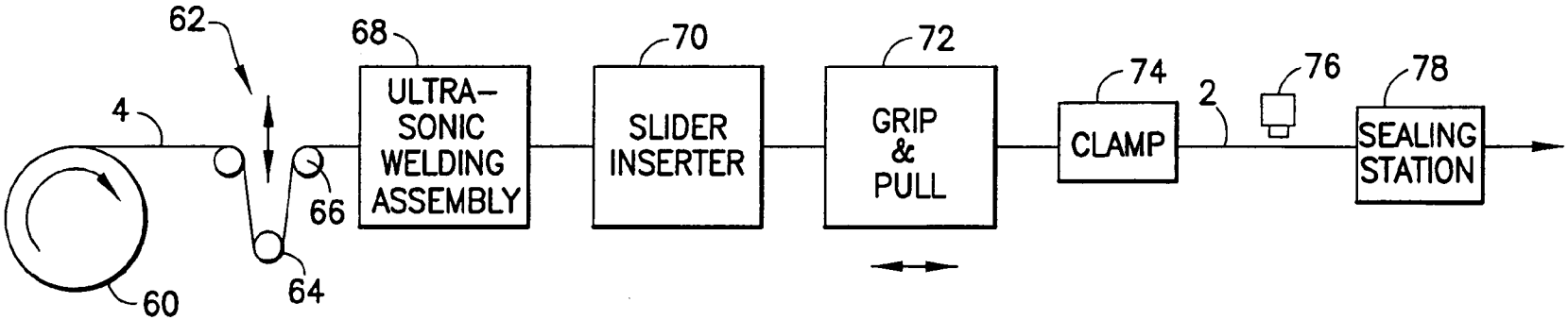
FIG. 2 is a block diagram representing automated equipment for inserting sliders and forming slider end stop structures on a fastener tape and then joining the fastener tape to packaging material in a TFFS machine in accordance with one embodiment of the invention.
Figure 3:
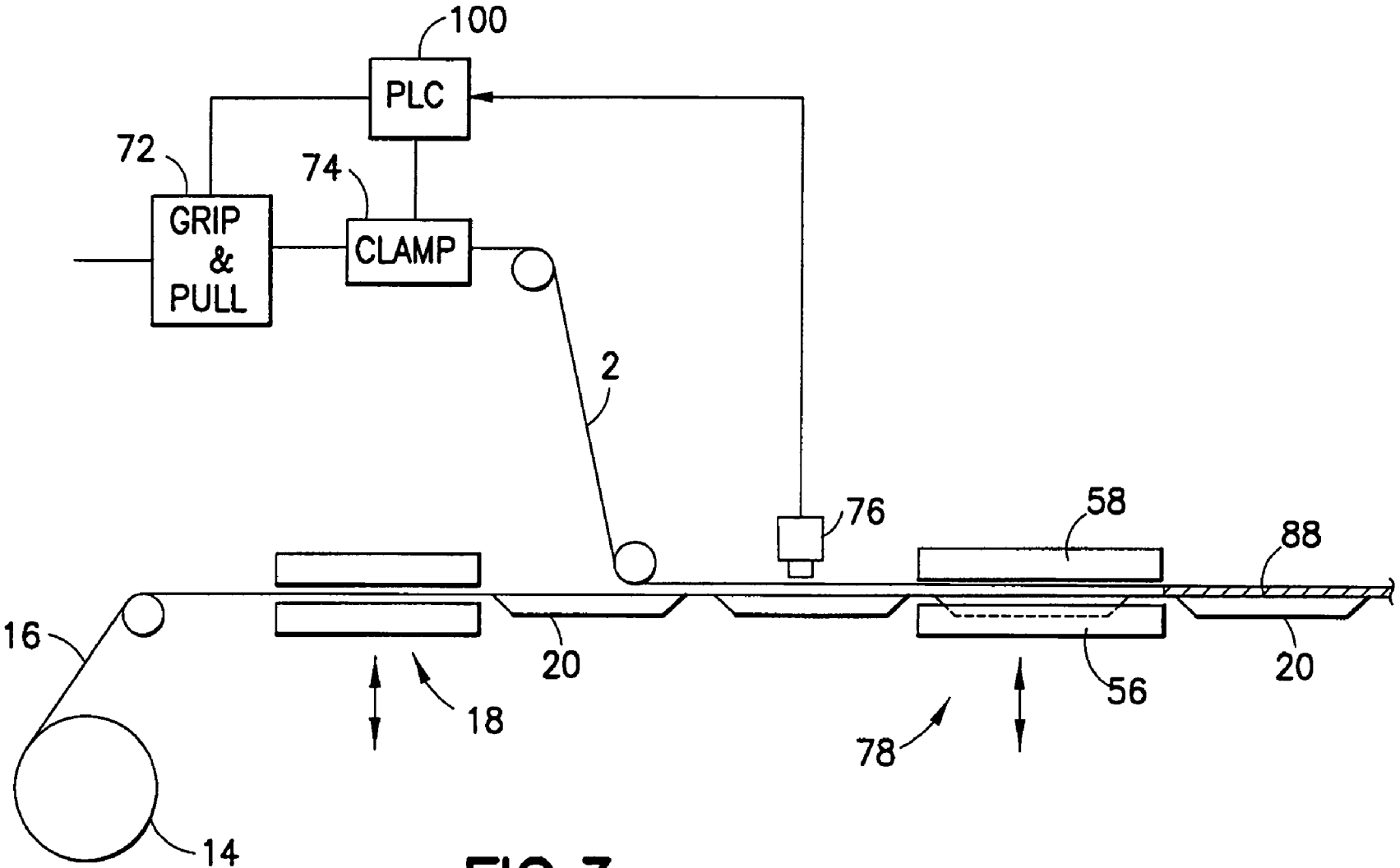
FIG. 3 is a drawing showing portions of the fastener tape and packaging material process pathways (which overlap inside the TFFS machine) in accordance with the disclosed embodiment.
Figure 4:
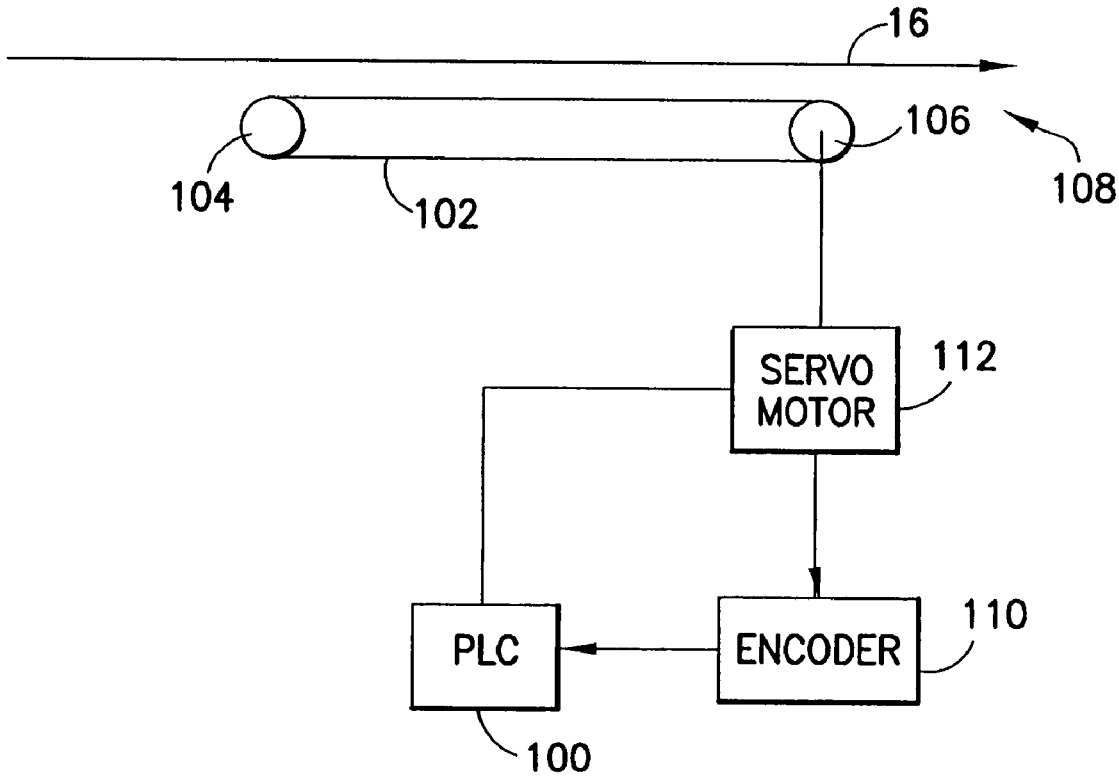
FIG. 4 is a block diagram showing a subsystem for providing a programmed logic controller with counting signals during advancement of the packaging material in the TFFS machine in accordance with the disclosed embodiment.

In accordance with one embodiment of the present invention, each thermoformed package is manufactured with a slider-operated zipper. A system in accordance with that embodiment combines the fastener tape processing system shown in FIG. 2 with a TFFS machine. Only one component of the TFFS machine, namely, a sealing station 78, where the fastener tape is joined to the bottom web of packaging material, is shown in FIG. 2. Various known components of the TFFS machine that are disposed upstream of the sealing station 78 are shown in FIG. 3. Various known components of the TFFS machine that are disposed downstream of the sealing station 78 are generally represented in FIG. 4.

Referring to FIG. 2, a length of thermoplastic fastener tape 4, comprising, e.g., respective continuous lengths of a pair of interlocked flanged zipper strips (e.g., of the type disclosed in U.S. Pat. No. 6,047,450), is unwound from a supply reel of a powered unwind stand 60 and passed through an unwind dancer assembly 62 comprising a weighted dancer roller 64 that is supported on a shaft, which shaft is freely vertically displaceable (as indicated by the double-headed arrow in FIG. 2) along a slotted support column (not shown). The weight of the dancer roller 64 takes up any slack in the portion of the fastener tape suspended between the supply reel 60 and a guide roll 66. A sensor (not shown in FIG. 2) may be provided for detecting the vertical position of the dancer roller 64. The feedback signal from that sensor is used by a PLC (not shown in FIG. 2) to control the motor that powers the unwind stand 60, thereby controlling the payout of fastener tape 4.

An ultrasonic welding assembly 68 is disposed downstream of the guide roll 66. During each dwell time, the plastic zipper strips are softened and/or melted and shaped by the ultrasonic welding assembly in a respective zone. The ultrasonically welded plastic material of the respective zipper strips is shaped to form a respective slider end stop structure in each zone upon cooling. The deformed portions of the zipper strips are also fused together in each zone. Each slider end stop structure will form back-to-back slider end stops when the end stop structure is cut during bag formation. The ultrasonic welding assembly 68 may comprise an ultrasonic transducer acoustically coupled to a horn, the horn being opposed by an anvil (not shown in FIG. 2). Either the horn or the anvil or both reciprocate between retracted and extended positions. The ultrasonic transducer is activated and the horn and/or anvil is extended in response to activation signals from the PLC (not shown in FIG. 2). While a portion of the fastener tape is being pressed between the horn and anvil, the horn emits ultrasonic wave energy at an intensity and frequency designed to soften and/or melt the thermoplastic fastener tape during each dwell time. The horn and/or anvil may be provided with recesses designed to form the softened and/or molten thermoplastic material into a slider end stop structure. When the softened/melted material cools, the material of the respective zipper strips fuses together to form a zipper joint.

The ultrasonically welded and shaped portion of fastener tape is then advanced to the next station, comprising a conventional slider insertion device 70 that inserts a respective slider (not shown in FIG. 2) onto each package-length section of fastener tape during each dwell time. Each slider is inserted adjacent a respective slider end stop structure on the continuous fastener tape. The slider insertion device comprises a reciprocating pusher that is alternately extended and retracted by an air cylinder (not shown in FIG. 2). The pusher of the slider inserter 70 is extended in response to activation signals from the PLC (not shown in FIG. 2). As the pusher extends, it pushes the slider onto the fastener tape. The other parts of such a slider insertion device, including a track along which sliders are fed, are well known and will not be described in detail herein.

During each dwell time, the fastener tape is gripped by a clamp 74, so that the unwound length of fastener tape spanning the distance between guide roller 66 and clamp 74 is stationary during ultrasonic welding and slider insertion. The clamp 74 may comprise a clamping gripper assembly of the type disclosed in U.S. patent application Ser. No. 11/081,369 and entitled "Apparatus for Repeatedly Advancing Fastener Tape a Predetermined Distance". This clamping gripper assembly comprises a pair of oppositely moving gripper arms (not shown). When the clamping gripper assembly is in a closed state, respective gripper pads on the gripper arms grip a first section of the length of straight zipper material. The gripper arms are actuated by a double-acting parallel motion air cylinder (not shown in FIG. 2), which is controlled by the aforementioned PLC. The clamping gripper assembly may comprise a carriage that is slidable along a straight rail to allow adjustment of its longitudinal position. But once the adjustment has been made, the clamping gripper assembly is secured relative to the rail, e.g., by means of a thumbscrew, so that the clamping gripper assembly is stationary during machine operation.

At the end of each dwell time, the fastener tape is gripped by a grip-and-pull mechanism 72 and then released by the clamp 74. Also, the ultrasonic horn or anvil or both are retracted and the pusher of the slider inserter is retracted, so that the length of fastener tape is free to advance. Then the grip-and-pull mechanism 72 is operated to pull the unwound length of fastener tape (ultrasonically stomped and carrying sliders) forward a desired distance. As will be explained in detail below, in accordance with one embodiment, the stroke of the grip-and-pull mechanism 72 is adjusted to be approximately equal to the distance that the bottom web of package material moves during each advancement. [Alternatively, if means are provided for stretching the section of fastener tape being sealed to the bottom web in the packaging machine, the stroke of the grip-and-pull mechanism 72 is adjusted to be approximately equal to the distance that the bottom web of package material moves during each advancement less any increase in the length of the fastener tape caused by the stretching.] During pulling of the portion of the fastener tape disposed upstream of the clamp 74, the most recently inserted slider leaves the slider insertion zone and the most recently formed slider end stop structure is moved from the ultrasonic welding station to the slider insertion zone. The clamp 74 is then closed again, following which the grip-and-pull mechanism 72 is opened and returned to its home position.

The grip-and-pull mechanism 72 may comprise an indexing gripper assembly that is linearly displaced by an indexing drive mechanism as disclosed in the aforementioned U.S. patent application Ser. No. 11/081,369. The indexing gripper assembly comprises a carriage that rides on a straight rail. The indexing drive mechanism comprises a lead screw driven to rotate by a servomotor under the control of the PLC. The indexing gripper assembly further comprises a nut threadably coupled to the lead screw and rigidly coupled to the carriage. The nut converts the rotation of the lead screw into linear displacement of the carriage. The indexing gripper assembly further comprises a pair of oppositely moving gripper arms. When the indexing gripper assembly is in a closed state, respective gripper pads on its gripper arms grip a second section (disposed upstream of the clamped first section) of the length of fastener tape. The gripper arms of the indexing gripper assembly are actuated by a double-acting parallel motion air cylinder, which is again controlled by the PLC.

Downstream from the clamp 74, the slider/fastener tape assembly 2 passes in front of a sensor 76 and then through a sealing station 78. As seen in FIG. 2, the sensor 76 is disposed between the clamp 74 and the sealing station 78. In this particular example, the sensor 76 is arranged to detect the leading edge of a respective slider end stop structure on the fastener tape as the slider end stop structure passes in front of the sensor during each intermittent advancement. (Alternatively, the sensor could be arranged to detect the leading edge of each slider or the leading edge of each flange seal, as previously disclosed.) During each dwell time, the section of fastener tape resident at sealing station 78 is joined by conductive heat sealing to a corresponding section of the bottom web (not shown in FIG. 2, but see FIG. 3).

Various known components of the TFFS machine that are disposed upstream of the sealing station 78 are shown in FIG. 3. The components shown in FIG. 3 that bear reference numerals previously seen in FIG. 2 have the functionality previously described.

As depicted in FIG. 3, the signals output by the sensor 76 are fed back to a PLC 100, which processes the signal information to derive the precise instant when the leading edge of each slider end stop structure (or slider) was detected. The PLC 100 then uses that information, with other information from the TFFS machine (described later with reference to FIG. 5), to adjust the stroke of the grip-and-pull mechanism 72 in a manner that maintains proper registration of the slider end stop structures relative to the thermoformed troughs 20 of the bottom web 16.

Still referring to FIG. 3, the bottom web 16 is unrolled from a supply roll 14 and pulled through a thermoforming station 18, where a respective trough 20 for product is formed by deep-drawing using vacuum and heat during each dwell time. One trough is formed for each package-length section of packaging material, but the trough is surrounded by a perimeter of packaging material that is not thermoformed, including a lateral margin where a package-length section of the slider/fastener tape assembly 2 will be attached. The thermoformed bottom web is advanced to the sealing station 78, where a respective package-length section of fastener tape is joined to each package-length section of the bottom web.

More specifically, a respective section of the slider/fastener tape assembly 2 (comprising a pair of interlocked zipper strips with a respective slider mounted thereon) is joined to the bottom web 84 by conventional conduction heat sealing during each dwell time. This may be accomplished by a reciprocating heated sealing bar 56 arranged below the bottom web 84. The sealing bar 56 reciprocates between retracted and extended positions under the control of the PLC 100. In the extended position, the heated (i.e., "hot") sealing bar 56 presses against a stationary unheated (i.e., "cold") bar 58, with the flanges of the zipper strips and the non-thermoformed margin of the bottom web sandwiched therebetween. When sufficient heat and pressure are applied, the bottom web 84 is joined to the flange of the lower zipper strip by conductive heat sealing. To prevent seal-through of the zipper flanges, just enough heat is conducted into the zipper material from the hot sealing bar. Alternatively, a separating plate may be interposed between the flanges during sealing, or the zipper flanges may have a laminated construction comprising sealant layers on the exterior surfaces or non-sealant layers on the interior surfaces.

Preferably, the sensor 76 is fixed at a location that will lie between successive slider end stop structures (or sliders or flange seals) upon completion of each intermittent advancement, i.e., during each dwell time. For example, the sensor 76 may be located midway between successive slider end stop structures of the section of the stationary fastener tape disposed in front of the sensor. During each advancement, the sensor 76 provides feedback signals to the PLC 100 that contain information indicating the precise instant of time when the leading edge of the slider end stop structure (or slider or flange seal) passed a precise location relative to the sensor. Any suitable optical or mechanical detecting means can be used. Several embodiments of suitable optical detecting means are disclosed in U.S. patent application Ser. No. 11/125,755 filed May 9, 2005 and entitled "Methods for Sensing Features on Moving Fastener Tape During Automated Production". Suitable optical detecting means include, but are not limited to, a laser thru-beam photoelectric sensor (e.g., the LX2 Series commercially available from Keyence Corporation); a laser scan micrometer (e.g., the LS-5000 Series commercially available from Keyence Corporation); a fiber-optic sensor (e.g., the FS-V20 Series commercially available from Keyence Corporation); or a laser displacement sensor (e.g., the LK Series commercially available from Keyence Corporation or the laser displacement sensor disclosed in U.S. Pat. No. 6,624,899). In general, optical detection of the leading edge or boundary of the structural feature of interest involves transmitting light that impinges on the fastener tape or other elongated continuous structure and then detecting portions of the transmitted light after it has interacted with the leading edge or boundary.

In response to a sensor feedback signal indicating the instant when the leading edge of the attachment or modified structure is detected, the PLC 100 correlates that event with a count signal representing the position of the concurrently advancing bottom web 16. Each leading edge detection event is correlated with a respective count, thereby enabling the PLC to compare the distance between successive leading edges to the distance by which the bottom web has advanced, which distance is directly proportional to the count A subsystem for providing the count signal representing the advancement of the bottom web to the PLC 100 is generally depicted in FIG. 4. The bottom web 16 may be intermittently advanced by conventional means 108. The portion of the bottom web 16 paid out from the bottom web supply roll (item 14 in FIG. 3) is advanced by a pair of endless chain belts 102 (only one of which is depicted in FIG. 4, the other being directly behind) that circulate on respective sprocket wheels 104 and 106, the latter of which is driven as explained below. In a known manner, spring-loaded clamps (not shown in FIG. 4) are mounted to both chain belts 102 for clamping the lateral margins of the bottom web 16. As the chain belts 102 circulate, the clamps carried thereon pull the bottom web through the sealing station 78. The structural details concerning the various components of the web advancing means 108, such as spring-loaded clamps, respective bearing-mounted sprocket wheels and respective engagement discs associated with the sprocket wheels and serving to open the spring-loaded clamps, are disclosed in full in U.S. Pat. No. 4,826,025 and will not be described in detail herein. Alternatively, a pair of drive belts that bear against the lateral margins of the bottom web could be used in place of the chain belts with spring-loaded clamps.

Still referring to FIG. 4, rotation of the sprocket wheel 106 is driven by a servomotor 112, which is controlled by the PLC 100. During operation of the TFFS machine, the PLC 100 is programmed to activate the servomotor 112 at regular intervals interspersed with dwell times. During each activation, the servomotor 112 causes the bottom web to be advanced by a constant indexing distance equal to one package length. The shaft of servomotor 112 is coupled to an encoder 110 that encodes shaft rotation by outputting a number proportional to the angle of rotation. That number, which is also proportional to the distance that the bottom web is advanced, is provided as feedback to the PLC 100. Provided that the servomotor is activated in a repeatable manner, the number output by the encoder 110 will increase by the same amount for each intermittent advancement of the bottom web. For example, the encoder count might increase by 1000 for each package-length advancement of the bottom web. This increasing count will be provided as feedback from the encode 110 to the PLC 100.

The PLC 100 is programmed to adjust the distance between the leading edges of successive slider end stop structures (or other modifications) or sliders (or other attachments) to compensate for any variation from one package length. As explained in detail hereinafter, the PLC accomplishes this by adjusting the forward stroke of the grip-and-pull mechanism.

For the exemplary implementation wherein one package length=1000, assume that the encoder count is 1500 when the n-th leading edge is detected and 2480 when the (n+1)-th leading edge is detected. The difference in these counts is 2480−1500=980, meaning that the distance between the n-th and the (n+1)-th leading edges deviates by −2% from one package length (=1000). To adjust for this deviation, PLC 100 controls the grip-and-pull mechanism to increase its forward stroke by a distance equal to 2% of one package length. In general, if the count separating leading edge detection events deviates from the count representing one package length by −x%, then the forward stroke of the grip-and-pull mechanism will be increased by a distance equal to x% of one package length. Conversely, if the count separating leading edge detection events deviates from the count representing one package length by +x%, then the forward stroke of the grip-and-pull mechanism will be decreased by a distance equal to x% of one package length. This is only one possible algorithm that can be used. A person skilled in the art will readily appreciate that many different algorithms could be employed to adjust the distance between successive leading edges of structural features repeatedly attached or formed on the fastener tape. For example, the adjustment to the stroke of the grip-and-pull mechanism could be a function of a moving average deviation over multiple work cycles.

Figure 5:
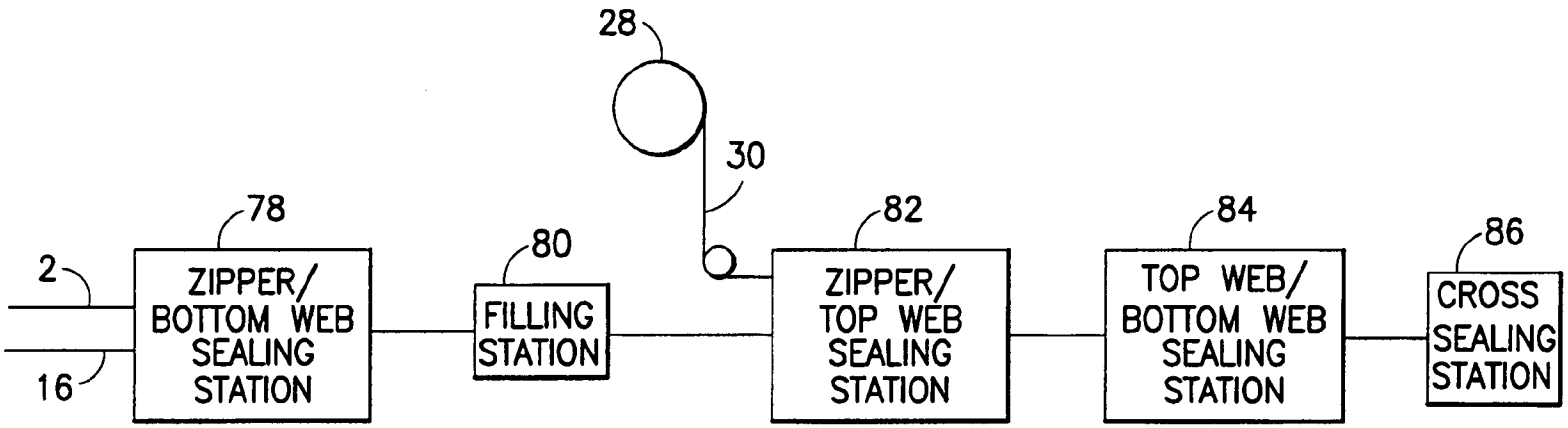
FIG. 5 is a block diagram showing various stages in the TFFS machine in accordance with the disclosed embodiment.

Various known components of the TFFS machine that are disposed downstream of the sealing station 78 are generally represented in FIG. 5. Each trough is filled with product at a filling station 80. (Filling may alternatively occur upstream of the sealing station 78 or adjacent thereto.) After filling, a top web 30 of packaging material is paid out from a top web supply roll 28 and joined to the flange of the upper zipper strip of the fastener tape 2 by conductive heat sealing at a sealing station 82. The sealing station 82 may be similar in construction to the sealing station 78 except the heated sealing bar will be on top instead of on the bottom. Thereafter, the top web 30 is joined to the bottom web 16 along the perimeter of the trough at another sealing station 84. (Alternatively, the top and bottom webs could be joined along a portion of the trough perimeter at sealing station 82 and along the remainder of the trough perimeter at sealing station 84.) Each trough is hermetically sealed along its perimeter only after the inside of each filled trough has been evacuated. [In the case where each package is provided with a header, the top and bottom webs extend beyond the closure profiles of the zipper strips, and the overlapping marginal portions of the top and bottom webs are joined together to form a header seal. This can be done concurrently with sealing of the perimeter of the trough.] Thereafter, the top and bottom webs are cross sealed to each other and to the fastener tape at a cross sealing station 86. Each cross seal extends across the full width of the package along a transverse zone that passes between successive troughs. Then the top and bottom webs and the zipper strips are cut along a transverse line (at a cross cutting station not depicted in FIG. 5) that bisects the cross seal, thereby severing the leading completed package from the remainder of the work in process.

Figure 6:
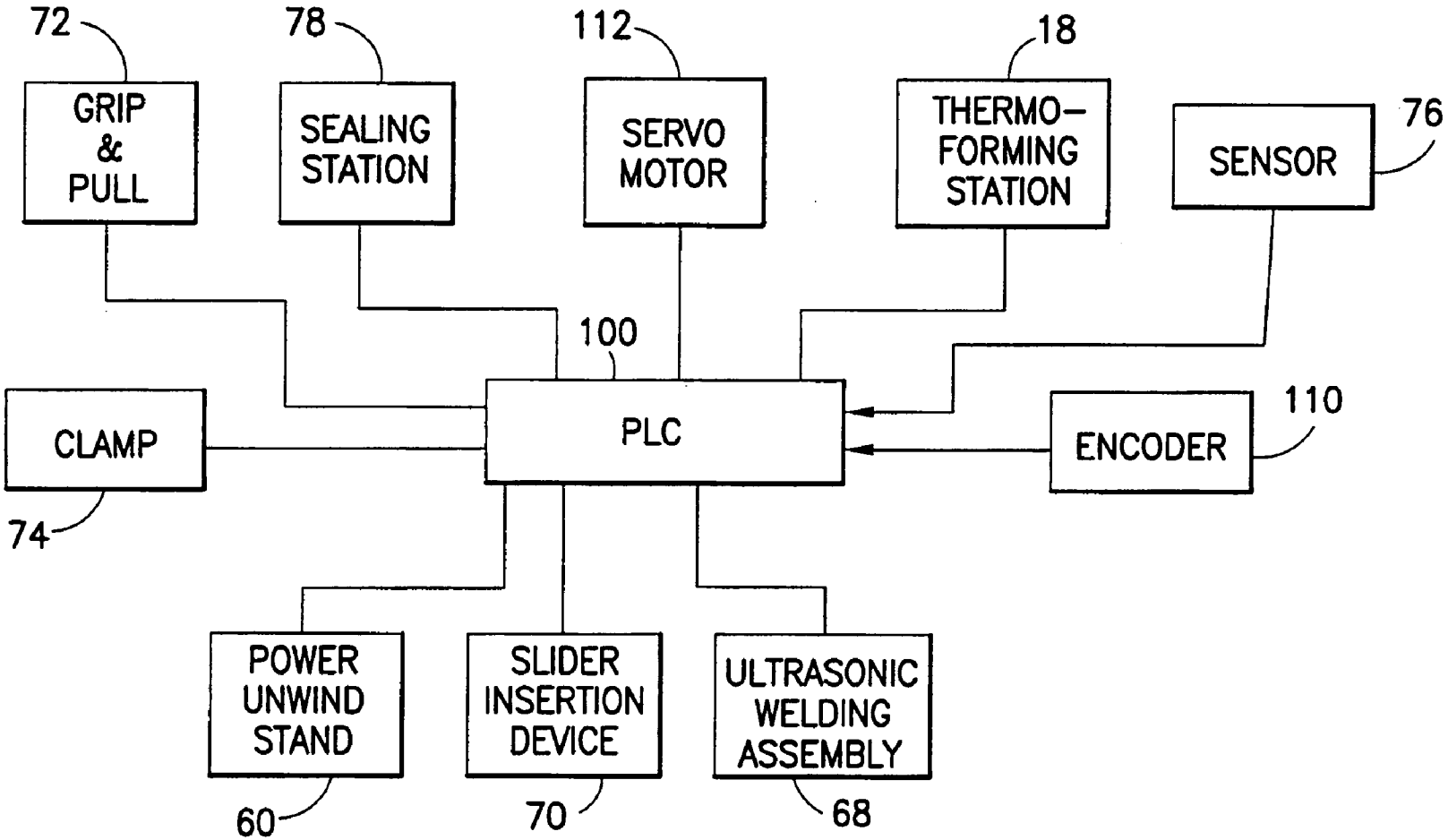
FIG. 6 is a block diagram generally representing programmable control of various components of the disclosed embodiment.

In accordance with one implementation of the disclosed embodiment shown in FIG. 6, the PLC 100 controls all of the activatable components depicted in FIG. 1. More specifically, the PLC is programmed to control various solenoids that open various strategically placed valves that, when open, connect a source of compressed air to various air cylinders. These air cylinders in turn respectively actuate movement of various components represented in FIG. 6, such as the following: (a) an indexing gripper assembly of the grip-and-pull mechanism 72; (b) a stationary gripper assembly of the clamp 74; (c) a horn (or anvil) of the ultrasonic welding assembly 68; and (d) a pusher of the slider insertion device 70. The PLC 100 also controls a waveform generator that supplies an electrical waveform to an ultrasonic transducer, which transducer in turn outputs acoustic waves that are delivered to the fastener tape by the aforementioned horn of the ultrasonic welding assembly 68. In addition, the PLC 100 controls various servomotors including the following: (a) a servomotor (not shown in FIG. 6) that drives rotation of a lead screw of the grip-and-pull mechanism 72, which rotation is converted into linear displacement of the indexing gripper assembly by means of the type previously described: (b) a servo motor that drives rotation of the power unwind stand 60; and (c) the servomotor 112 that drives advancement of the bottom web through the packaging machine. The PLC 100 also controls the operations of the thermoforming station 18 and the various sealing stations, the sealing station 78 for joining the bottom web to the fastener tape being the only sealing station depicted in FIG. 6.

Furthermore, as previously explained in detail, the PLC 100 receives feedback from the sensor 76 and the encoder 110, and then controls the servomotor that drives rotation of the lead screw of the grip-and-pull mechanism 72. By controlling that the number of revolutions of the servomotor, the PLC can adjust the forward stroke of the grip-and-pull mechanism 72 to advance the fastener tape by a desired distance. As previously explained, the adjustment is a function of the discrepancy between the distance separating successive leading edges of the slider end stop structures (or the sliders), which distance is detected by the sensor 76, and the distance by which the bottom web is advanced, which is reflected in the change in the count from the encoder 110 as the result of each bottom web advancement.

The PLC 100 is programmed to control the various components represented in FIG. 6 in accordance with a regular work cycle. In particular, the TFFS machine and the zipper processing machine must be coordinated such that the bottom web of packaging material and the fastener tape are both stationary during each dwell time and are both advanced during the remainder of each work cycle. Accordingly, during the advancement phase, the PLC 100 activates the servomotor of the power unwind stand 60 to pay out wound fastener tape; activates the servomotor of the grip-and-pull mechanism 72 to advance previously paid-out fastener tape; and activates the servomotor 112 of the web advancement mechanism to advance the bottom web. During this phase, the clamp 74 is open. At the end of the forward stroke of the grip-and-pull mechanism 72, the clamp 74 is closed, thereby gripping the portion of fastener tape thereat. Once the fastener tape has been gripped by the clamp, the ultrasonic welding assembly 68 and the slider insertion device 70 are activated in the zipper processing machine, and the thermoforming station 18 and the sealing station 78 (and other sealing stations) of the TFFS machine are activated. While these operations are being performed, the PLC 100 activates the servomotor of the grip-and-pull mechanism 72 to cause the grip-and-pull mechanism 72 to return to its home position and await the next advancement phase. During each advancement phase, the PLC 100 receives feedback from the sensor 76 and the encoder 110, as previously described in detail. Naturally the PLC also controls other components such as the evacuation means and the cutting means of the TFFS machine. The PLC 100 is typically a computer or a processor having associated memory that stores a program for operating the machine.

The various components that move between retracted and extended positions (e.g., slider pusher, ultrasonic horn, clamp, sealing bar, etc.) may be coupled to respective double-acting pneumatic cylinders (not shown in FIG. 6). Operation of the cylinders is controlled by the PLC 100, which selectively activates the supply of fluid to the double-acting cylinders in accordance with an algorithm or logical sequence. Hydraulic cylinders can be employed as actuators in place of air, i.e., pneumatic, cylinders. A person skilled in the art of machinery design will readily appreciate that displacing means other than a cylinder can be used to displace components such as the horn of the ultrasonic welding assembly and the pusher of the slider inserter. For the sake of illustration, such mechanical displacement devices include rack and pinion arrangements or lead screw/coupling nut assemblies, rotation of the pinion or lead screw being driven by an electric motor.

The above-disclosed embodiment comprises a fastener tape processing subsystem in which slider end stop structures are ultrasonically stomped at intervals along the fastener tape and then sliders are inserted between the slider end stop structures. However, the present invention is not limited in its application to situations of this type. The invention has application in situations where a fastener tape is crushed, stomped, notched or otherwise modified, so long as a boundary of the modification can be accurately detected by a fixed device as the fastener tape advances. Optical or physical means can be used to "look" at the modified section of the fastener tape. Looking at the modified section and recording when that section is "seen", with respect to the TFFS machine's indexing cycle, allows the zipper lengths to be modified upstream of the TFFS machine. By knowing when the modified section is supposed to be "seen" and when it is actually "seen", depending on whether the "sighting" was too soon or too late, allows for corrections, e.g., the distance by which the fastener tape is advanced during each work cycle can be adjusted.

While the invention has been described with reference to preferred embodiments, it will be understood by those skilled in the art that various changes may be made and equivalents may be substituted for members thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the verb "joined" means fused, bonded, sealed, adhered, etc., whether by application of heat and/or pressure, application of ultrasonic energy, application of a layer of adhesive material or bonding agent, interposition of an adhesive or bonding strip, etc. As used in the claims, the term "controller" means a programmed logic controller, an electronic computer, a central processing unit, a microchip, a microcontroller or other programmable device or a system of interconnected and synchronized control units, each control unit comprising a programmed logic controller, an electronic computer, a central processing unit, a microchip, a microcontroller or other programmable device. Furthermore, in the absence of explicit language in any method claim setting forth the order in which certain steps should be performed, the method claims should not be construed to require that steps be performed in the order in which they are recited.

The invention claimed is:

1. A method of manufacture comprising the following steps:

(a) during a respective indexing portion of a respective work cycle, advancing a first elongated continuous structure made of flexible material along a first process pathway, said first elongated continuous structure not advancing during a dwell time of a respective work cycle;

(b) during each dwell time, forming or attaching a respective structural feature of a first type on the portion of said first elongated continuous structure that is resident at a first fixed station situated along said first process pathway, said structural features of said first type being spaced at intervals along the portion of said first elongated continuous structure that is downstream of said first fixed station;

(c) during the indexing portion of each work cycle, advancing a second elongated continuous structure made of flexible material along a second process pathway by the same distance, said first and second process pathways becoming a common process pathway at a point downstream of said first fixed station and at or upstream of a second fixed station, said second elongated continuous structure not advancing during each dwell time;

(d) during each dwell time, joining respective portions of said first and second elongated continuous structures that are resident at said second fixed station, thereby forming respective band-shaped zones of joinder disposed in sequence along the portion of said common process pathway downstream of said second fixed station; and (e) adjusting the distance that the portion of said first elongated continuous structure that is resident at said first fixed station advances during a subsequent advancement as a function of the difference between the distance traveled by said web during a prior advancement and the distance between boundaries of successive structural features of said first type on a portion of said first elongated continuous structure that is disposed between said first and second fixed stations at the time of said prior advancement.

2. The method as recited in claim 1, wherein said first elongated continuous structure comprises first and second plastic zipper strips that are interlocked with each other, each of said structural features of said first type is a respective slider inserted on said interlocked first and second zipper strips, and said second elongated continuous structure comprises a web of flexible packaging material.

3. The method as recited in claim 1, further comprising the step, performed during each dwell time, of forming a respective structural feature of a second type on the portion of said second elongated continuous structure that is resident at a third fixed station situated along said second process pathway upstream of said common process pathway, said structural features of said second type being spaced at intervals along the portion of said second elongated continuous structure that is downstream of said third fixed station.

4. The method as recited in claim 3, wherein said first elongated continuous structure comprises first and second plastic zipper strips that are interlocked with each other, each of said structural features of said first type is a respective slider inserted on said interlocked first and second zipper strips, said second elongated continuous structure comprises a web of flexible packaging material, and each of said structural features of said second type is a respective trough thermoformed in said web.

5. A method of manufacture comprising the following steps:

(a) during a respective indexing portion of a respective work cycle, advancing a first elongated continuous structure made of flexible material along a first process pathway, said first elongated continuous structure not advancing during a dwell time of a respective work cycle;

(b) during each dwell time, forming or attaching a respective structural feature of a first type on the portion of said first elongated continuous structure that is resident at a first fixed station situated along said first process pathway, said structural features of said first type being spaced at intervals along the portion of said first elongated continuous structure that is downstream of said first fixed station;

(c) during the indexing portion of each work cycle, advancing a second elongated continuous structure made of flexible material along a second process pathway by the same distance, said first and second process pathways becoming a common process pathway at a point downstream of said first fixed station and at or upstream of a second fixed station, said second elongated continuous structure not advancing during each dwell time;

(d) during each dwell time, joining respective portions of said first and second elongated continuous structures that are resident at said second fixed station, thereby forming respective band-shaped zones of joinder disposed in sequence along the portion of said common process pathway downstream of said second fixed station;

(e) during each dwell time, forming a respective structural feature of a second type on the portion of said second elongated continuous structure that is resident at a third fixed station situated along said second process pathway upstream of said common process pathway, said structural features of said second type being spaced at intervals along the portion of said second elongated continuous structure that is downstream of said third fixed station;

(f) monitoring the length of the portion of said second elongated continuous structure that passes a fixed point along said common process pathway during an advancement thereof;

(g) during an advancement of said first elongated continuous structure and at a fourth fixed station disposed downstream of said first fixed station, monitoring the distance between respective boundaries of successive ones of said structural features of said first type spaced along said first elongated continuous structure; and (h) comparing said monitored length and said monitored distance.

6. The method as recited in claim 5, further comprising the following step:

adjusting the distance that the portion of said first elongated continuous structure resident at said first fixed station is advanced, the magnitude of the adjustment being a function of a difference between said monitored length and said monitored distance.

7. The method as recited in claim 5, further comprising the following step:

during each dwell time and at a fifth fixed station situated along said first process pathway, forming or attaching a respective structural feature of a third type on said first elongated continuous structure, said structural features of said third type being spaced at intervals along the portion of said first elongated continuous structure that is downstream of said fifth fixed station.

8. The method as recited in claim 7, wherein each structural feature of said first type is a respective slider and each structural feature of said second type is a respective slider end stop.

9. The method as recited in claim 5, wherein steps (f), (g) and (h) are performed during each advancement of said first and second elongated continuous structures.

10. The method as recited in claim 5, wherein step (f) comprises the step of encoding the angle of rotation of a component in a first device that advances said second elongated continuous structure, the distance advanced being directly proportional to the angle of rotation of said component in said first device.

11. The method as recited in claim 5, wherein step (g) comprises the step of detecting a leading boundary of each of said structural features of said first type.

12. The method as recited in claim 5, wherein step (h) comprises the step of changing the angle of rotation of a component in a second device that advances said first elongated continuous structure along said first process pathway, the adjusted distance being directly proportional to the change in the angle of rotation of said component in said second device.

13. The method as recited in claim 5, wherein said second elongated continuous structure comprises a web of flexible packaging material, and each of said structural features of said second type is a respective trough thermoformed in said web.

14. The method as recited in claim 13, wherein said first elongated continuous structure comprises first and second plastic zipper strips that are interlocked with each other, and each of said structural features of said first type is a respective decrease in thickness of said interlocked first and second zipper strips.

15. The method as recited in claim 13, wherein said first elongated continuous structure comprises first and second plastic zipper strips that are interlocked with each other, and each of said structural features of said first type is a respective notch in said interlocked first and second zipper strips.

16. The method as recited in claim 13, wherein said first elongated continuous structure comprises first and second plastic zipper strips that are interlocked with each other, and each of said structural features of said first type is a respective zone in which said first and second zipper strips are fused together.

17. The method as recited in claim 13, wherein said first elongated continuous structure comprises first and second plastic zipper strips that are interlocked with each other, and each of said structural features of said first type is a respective clip attached to said interlocked first and second zipper strips.

18. The method as recited in claim 5, wherein said first elongated continuous structure comprises first and second plastic zipper strips that are interlocked with each other, and each of said structural features of said first type is a respective slider inserted on said interlocked first and second zipper strips.

19. The method as recited in claim 5, wherein said fourth fixed station is disposed upstream of said second fixed station.

20. A system comprising a packaging machine, a fastener processing machine, a fastener tape comprising mutually interlocked first and second zipper strips made of flexible material that follow a first process pathway through said fastener processing machine and then through said packaging machine, and a controller for controlling the operation of said packaging machine and said fastener processing machine, wherein:

said fastener processing machine comprises a supply reel having a portion of said fastener tape wound thereon with a paid-out portion of said fastener tape connected thereto, a first device for attaching or forming a respective structural feature of a first type on the section of the paid-out portion of said fastener tape that is resident in a fixed zone along said first process pathway, means for advancing the section that is resident in said fixed zone along said first process pathway and toward said packaging machine, and a sensor that detects a boundary of each passing structural feature of said first type as said fastener tape is advanced;

said packaging machine comprises a supply roll having portions of a web of bag making material wound thereon with a paid-out portion of said web connected thereto, means for advancing the paid-out portion of said web along a second process pathway, an encoder for encoding the distance traveled by said advancing paid-out portion of said web, and a second device for joining respective sections of the paid-out portions of said fastener tape and said web to each other while the paid-out portions of said fastener tape and said web are stationary, wherein said first and second process pathways meet at said second device; and said controller is programmed to control the operation of said first and second devices, said fastener tape advancing means, and said web advancing means so that during an advancement phase of each work cycle, said web advancing means advances said web and said fastener tape advancing means advances said fastener tape; and during a dwell time of each work cycle, said first and second devices are activated, and is further programmed to adjust the distance that said fastener tape advancing means advances said fastener tape during a subsequent advancement when signals output by said sensor and said encoder during prior advancements indicate a predetermined difference between the distance traveled by said advancing paid-out portion of said web and the distance between boundaries of successive structural features of said first type.

21. The system as recited in claim 20, wherein said first device comprises a slider inserter.

22. The system as recited in claim 20, wherein said first device comprises an ultrasonic welding assembly.

23. The system as recited in claim 20, wherein said second device comprises a heated sealing bar.

24. The system as recited in claim 20, wherein said packaging machine further comprises a third device for forming a respective structural feature of a second type on the section of the paid-out portion of said web that is resident in a fixed zone along said second process pathway.

* * * * *